United States Patent [19]

Inohara et al.

[11] 4,357,557

[45] Nov. 2, 1982

[54] GLASS SEALED THIN-FILM ELECTROLUMINESCENT DISPLAY PANEL FREE OF MOISTURE AND THE FABRICATION METHOD THEREOF

[75] Inventors: Akio Inohara, Osaka; Kiyoshi Sawae; Masashi Kawaguchi, both of Nara; Kinichi Isaka, Tenri, all of Japan

[73] Assignee: Sharp Kabushiki Kaisha, Osaka, Japan

[21] Appl. No.: 130,347

[22] Filed: Mar. 14, 1980

[30] Foreign Application Priority Data

| | | | |
|---|---|---|---|
| Mar. 16, 1979 | [JP] | Japan | 54-32162 |
| Sep. 26, 1979 | [JP] | Japan | 54-124330 |
| Sep. 29, 1979 | [JP] | Japan | 54-127111 |
| Dec. 27, 1979 | [JP] | Japan | 54-170851 |

[51] Int. Cl.[3] ..... H01J 1/62

[52] U.S. Cl. ..... 313/509; 313/512; 313/232

[58] Field of Search ..... 313/509, 512, 232, 498, 313/505, 506

[56] References Cited

U.S. PATENT DOCUMENTS 4,213,074 7/1980 Kawaguchi et al. ..... 313/509

FOREIGN PATENT DOCUMENTS 1501878 2/1978 United Kingdom ..... 313/512

*Primary Examiner*—Paul L. Gensler

*Attorney, Agent, or Firm*—Birch, Stewart, Kolasch & Birch

[57] ABSTRACT

A thin-film electroluminescent display panel is sealed by a pair of glass substrates for protection from the environment. A protective liquid is introduced between a counter glass substrate and a substrate for supporting the electroluminescent display unit. The protective liquid comprises silicone oil or grease which assures the thin-film electroluminescent film of preservation in the electroluminescent display panel. The counter glass substrate is bonded to the support substrate through an adhesive of, for example, photo-curing resin. A capillary tube is provided within the glass substrate for injecting the liquid under vacuum conditions. The liquid has the capability of spreading into pin holes generated on dielectric layers, and is resistant to high voltage, high humidity and high temperature and is inert to layers constituting the thin-film electroluminescent display panel and has a small vapour pressure and a small coefficient of thermal expansion. A moisture absorptive member is introduced into the protective liquid. The member can be an Al film coated by silica gel or silica gel particles themselves. The silica gel particles, if necessary, may be confined within a tube or dispersed within the spacer. Alternatively, they are dispersed within the protective liquid. The Al film is adhered to one of the substrates. The member serves to absorb moisture contained within the protective liquid. The protective liquid can be colored by a dye material to provide a background for the EL device.

28 Claims, 7 Drawing Figures

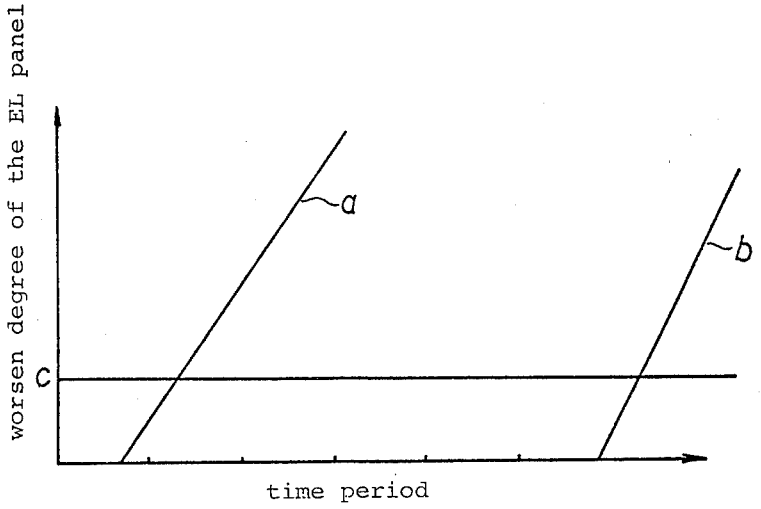
FIG.2
FIG.3
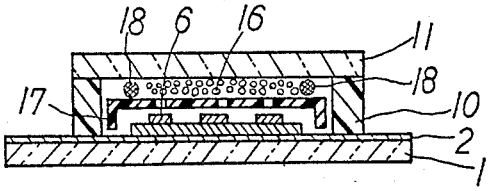
FIG.4
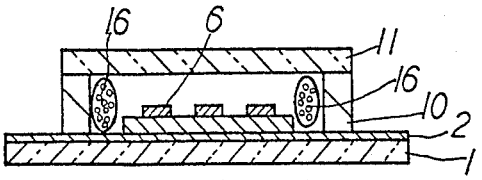
FIG.5
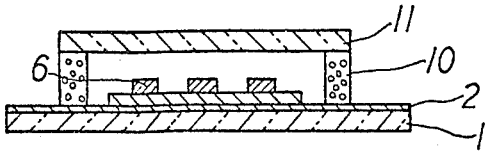

GLASS SEALED THIN-FILM ELECTROLUMINESCENT DISPLAY PANEL FREE OF MOISTURE AND THE FABRICATION METHOD THEREOF

BACKGROUND OF THE INVENTION

The present invention relates to a thin-film electroluminescent (referred to as "EL") display panel and, more particularily, to a thin-film EL display unit shielded by a pair of glass substrates from which moisture is completely removed, and the fabrication method.

There was filed on June 14, 1978 a U.S. patent application Ser. No. 915,447 by M. Kawaguchi et al entitled "THIN-FILM ELECTROLUMINESCENT DISPLAY PANEL SEALED BY GLASS SUBSTRATES AND FABRICATION METHOD THEREOF", now U.S. Pat. No. 4,213,074, assigned to the present assignee. The counterpart application was filed in England on July 31, 1978 as British patent application No. 31666/78 and in West German on July 25, 1978 as W. German patent application No. P 28 32 652.5.

In terms of a seal of an EL display panel by a pair of glass substrates including a protective liquid such as silicone oil or grease as disclosed in the above referred to applications, the introduction of moisture into a cavity defined by the pair of glass substrates from the surroundings was prevented to thereby increase the reliability and the life time of the EL display panel.

However, there were inherent disadvantages, owing to the fact that the protective liquid inevitably contains a small amount of moisture, such that the small amount of moisture inclusive in the protective liquid tended to penetrate into the EL display film, thus damaging the EL display unit.

OBJECTS AND SUMMARY OF THE INVENTION

Accordingly, it is a primary object of the present invention to provide a novel protective structure for a thin-film electroluminescent (EL) display film.

It is a another object of the present invention to provide a novel seal method for a thin-film EL display panel.

It is a further object of the present invention to provide a novel protective assembly adapted to a thin-film EL display panel by completely removing moisture from the surroundings of the thin-film EL display panel.

Other objects and further scope of applicability of the present invention will become apparent from the detailed description given hereinafter. It should be understood, however, that the detailed description and specific exemples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a pair of substrates, at least one of which being a transparent glass substrate, are provided for sealing a conventional electroluminescent (EL) display panel, together with the use of a protective liquid for the EL display unit. A spacer is positioned for determining the spacing between the pair of substrates. Injection holes are formed within one of the substrates to introduce the protective liquid into the cavity defined by the two substrates. An adhesive is adapted to provide bonding between the pair of the substrates and the spacer. The protective liquid has the ability of flowing into the pin holes produced in the dielectric layers of the EL display unit, and is also resistant to high voltage, high humidity and high temperature, is inert to the layers constituting the EL display unit and has a small vapour pressure and small thermal coefficient of expansion.

The protective liquid is preferably selected to be silicone oil or grease etc. The spacer is selected to be a polyacetal resin or polyamide resin or another type of insulating plastic. Silicone rubber and glass are applicable for use as the spacer. The adhesive is an epoxy resin and the like. A lead electrode for the EL display unit is extended toward the cavity defined by the two substrates. The lead electrode is coupled to a driver for applying an AC electric field into the EL display unit.

A moisture absorptive member is introduced into the protective liquid. The member is a sheet coated by silica gel or silica gel particles themselves. The silica gel particles, if necessary, may be confined within a tube or dispersed within the spacer. Alternatively, they are dispersed within the protective liquid. The sheet is adhered to one of the substrates. The member serves to absorb moisture contained within the protective liquid. The protective liquid can be colored by a dye material to provide a background for the EL device.

The protective structure for the EL display unit is completed in accordance with the following fabrication steps. At first, the EL display unit is disposed within the two substrates and the spacers, which are bonded together by an adhesive. This composite is soaked in a suitable protective liquid, while heating at a suitable temperature of one hundred to two hundred degrees centigrade. Simultaneously, the package is placed under a pressure below $10^{-2}$ torr or a vacuum state and the cavity is filled with the protective liquid. After removing the composite under room temperature and atmospheric pressure conditions, the injection hole is sealed by an adhesive.

BRIEF DESCRIPTION OF THE DRAWINGS

The present invention will become more fully understood from the detailed description given hereinbelow and accompanying drawings which are given by way of illustration only, and thus are not limitative of the present invention and wherein:

FIG. 2 is a graph representing comparison data of worsening properties between the conventional thin-film EL panel and the thin-film EL panel shown in FIG. 1; and FIGS. 3 through 7 are cross-sectional views of other forms of thin-film EL panels according to the present invention.

DESCRIPTION OF THE INVENTION

Figure 1:
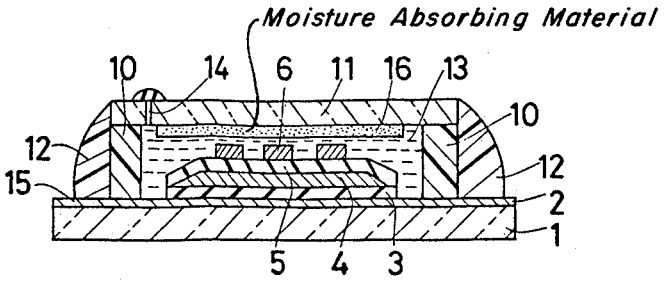
FIG. 1 is a cross-sectional view of a thin-film EL panel according to the present invention.

FIG. 1 shows a thin-film electroluminescent (EL) panel of the present invention. The thin-film EL panel comprises a transparent glass substrate 1, a plurality of transparent elecrodes 2 made of $In_2O_3$ or $SnO_2$ etc., a first dielectric layer 3, an EL thin-film 4, a second dielectric layer 5, a plurality of counter electrodes 6 made of, for example, Al, spacers 10, and a counter substrate 11 made of glass. The transparent electrodes 2 are arranged on the glass substrate 1 in parallel with each other. The counter electrodes 6 are arranged so that they cross at right angles relative to the transparent electrodes 2 in a plane view. A cross point between the transparent electrodes 2 and the counter electrodes 6 produces an element for the EL panel. An AC power energy is applied to the transparent electrodes 2 and the counter electrodes 6.

The first dielectric layer 3 comprises $Y_2O_3$, $TiO_2$, $Al_2O_3$, $Si_3N_4$, and $SiO_2$ etc. which is disposed by a sputtering technique or by electron beam evaporation. The EL thin film 4 is made of a ZnS thin film doped with manganese in a desired amount. The second dielectric layer 5 comprises a similar material as that of the first dielectric layer 3.

The EL panel provides a sealing structure for the EL unit, namely, the first and the second dielectric layers 3, 5 and the EL thin film 4. The counter substrate 11 is provided for sealing the EL unit together with the transparent glass substrate 1. The counter substrate 11 is not required to be transparent because viewing is made from the substrate 1. The spacers 10 are positioned for separating the counter substrate 11. An adhesive 12 is coated for bonding the transparent glass substrate 1, the spacer 10, and the counter substrate 11. A protective liquid 13 is contained within a cavity defined by the two substrates 1 and 11. The protective liquid 13 functions to preserve the EL unit. The protective liquid 13, can be silicone oil or grease which are suitable for vacuum sealing.

It is preferable that the protective liquid 13 has the following properties:

(1) capable of penetrating into pin holes generated on the dielectric layers 3 and 5;
(2) resistant to a high voltage;
(3) resistant to considerable heat and humidity;
(4) inert with the material of the EL unit; and
(5) has a small vapour pressure and a small coefficient of thermal expansion.

The items (1), (2), and (4) are very important factors for the protective liquid 13.

The spacer 10 is an insulating plastic sheet made of a polyacetal resin, a polyamide resin, a silicone rubber, or a glass plate. At least one injection hole 14 is formed within the counter substrate 11 for injecting the protective liquid. The adhesive 12 is an epoxy resin or the like. Lead terminals 15 of the transparent electrodes 2 and the counter electrodes 6 are formed on the transparent glass substrate 1 and extend toward the cavity. A control circuit (not shown) is coupled to the lead terminals 15 to apply the AC power energy to the EL unit.

A substantial amount of moisture inherently contained in the protective liquid 13 is removed by gas-removing process before the injection but, even then, a small amount of moisture inevitably remains within the liquid 13. Such a small amount of moisture is liable to damage the EL unit by penetrating through it. Such a small amount of moisture can be absorbed by absorptive agents according to the present invention, with the result that the EL unit is completely protected from moisture for the purpose of ensuring good operations.

On the inside of the counter substrate 11, there is formed an absorptive member 16 made of an aluminum film coated by silica gel. As the protective liquid 13 has non-ionic properties, the silica gel material can absorb ionic moisture inherently contained within the protective liquid 13 without any interference by it. The absorptive member 16 is adhered to the counter substrate 11 by an adhesion such as an epoxy resin or the like. In place of the aluminum member 16 coated by silica gel, a glass plate or a plastic plate both coated by silica gel can be adopted. Alternatively, a sheet composed of silica gel can be used which is also adhered to the counter substrate 11. In place of silica gel, any suitable material can be adapted.

The EL display panel shown in FIG. 1 is fabricated by the following manufacturing process. The EL unit is disposed on the transparent electrode 2 which is formed on the transparent glass substrate 1. The counter substrate 11 is positioned on the transparent glass substrate 1 so as to enclose the EL unit through the use of the spacer 10. The adhesive is coated over the two substrates 1 and 11, and the spacer 10. The thus composed EL panel is soaked in a tank containing the protective liquid 13. The tank is heated at a temperature of one to two hundred degree centigrade while withdrawing the atmosphere by pumping under $10^{-2}$ torr. Air and gas contained within the cavity are removed therefrom and the protective liquid 13 can be replaced through the injection hole 14. The EL panel is removed under the conditions of room temperature and the atmospheric pressure. The injection hole 14 is sealed by an adhesive of epoxy resin or the like to contain the protective liquid 13.

The air and gas are effectively removed by means of a vacuum pump. The evacuation of the air and the gas from the liquid 13 is enhanced by heating of the tank. Also the flowability of the protective liquid 13 is increased by the heating. Complete impregnation of the protective liquid 13 into the pin holes discussed above is thus achieved.

In this example shown in FIG. 1, the evacuation of gas from the silica gel layer must be carried out before the absorptive member 16 coated by the silica gel layer is confined within the cavity defined by the two substrates 1 and 11. If evacuation of gas from the silica gel layer is performed after the confinement of the absorptive member 16 within the cavity, the evacuation is required to be performed through a fine pass of the injection hole 14, wherein the efficiency of the movement is too low. Moreover, in such a case, there is a fear that the adhesive used for the housing of the EL panel will not be able to withstand the high temperature of about 120° to 150° C. in which the adhesive to connect the silica gel layer to the absorptive member 16 is hardened and the removement of gas from the silica gel layer is carried out.

FIG. 2 is a graph representing comparison data of worsening properties between a conventional thin-film EL panel not containing the sheet 16 and the thin-film EL panel containing the absorptive member 16 according to the present invention. Ten units of both thin-film EL panels were sampled to be exposed to a high temperature and high humidity. Data in connection with the conventional panels are represented by a line a while data in connection with the subject panels represented by a line b. A line c represents a lowest limit above which the panels became worse. Ordinate of the graph of FIG. 2 is the degree of worse and abscissa is time period.

As apparently shown in the graph, the life time of the subject panels containing the absorptive member 16 was about four to five times than that of the conventional panels not containing it. In this experiments, a thickness of silica gel coated on the member 16 was set to be within 100 $\mu$m. It should be noted that a thicker silica gel layer assures a longer life time of the thin-film EL panel.

FIGS. 3 through 5 show other forms of thin-film EL display panels according to the present invention. Throughout these drawings, like elements corresponding to those of FIG. 1 are indicated by like numerals.

In FIG. 3, there is provided in the thin-film EL panel the absorptive member 16 made of silica gel particles, a cover plate 17, and a spacer member 18. In this example, as the absorptive member 16, silica gel particles are used. The cover plate 17 is provided for covering the thin-film EL unit so that the silica gel particles are not visible from the display side in front of the glass substrate 1. The cover plate 17 is made of plastic or the like. It is preferable to arrange the cover plate 17 for the purpose of preventing the visibility of the silica gel particles because they are liable to precipitate too much to thereby damage the visibility of the panel. The spacer member 18 is provided for defining the location of the silica gel particles in combination with the cover plate 17.

In FIG. 4, the silica gel particles as the absorptive member 16 are confined within a tube. Such a tube has a surplus of pin holes, and otherwise high moisture-transparent properties. The tube is positioned peripheral to the thin-film EL unit.

In FIG. 5, the silica gel particles as the absorptive member 16 are dispersed within the spacers 10. Although the moisture absorptive properties in this arrangement are supposed to be slightly less than any of the other forms, this arrangement provides simpler production processes.

In still other forms of thin-film EL display panels according to the present invention, there is further provided a background for the EL device by adding a dye material to the protective liquid 13, properly positioning a colored background plate, or making the absorptive member 16 colored.

When a suitable dye material is added to the protective liquid 13 for coloration preferably such a dye material should have the following features:

(1) capable of being easily dissolved into the protective liquid 13 at room temperature or a temperature of about 60° to 70° centigrade;

(2) preventing most light transmitting properties of the protective liquid 13 when the liquid 13 so colored by the dye material is injected into the cavity of the housing of the thin-film EL display panel in a thickness of about 1 mm;

(3) maintaining the electrical insulating properties of the protective liquid 13 when dissolved in it;

(4) maintaining the moisture absorptive properties of the absorptive member 16 when dissolved in the protective liquid 13; and (5) ensuring electrical and optical features of the thin-film EL unit.

As far as these requirements are satisfied, any dye material can be used which allow the protective liquid 13 to be colored, e.g., blue, black or the like. Such a dye material is dispersed within the protective liquid 13 in a range of about 0.01 to 1.0 wt%.

According to the addition of the dye material into the protective liquid 13, a blue or black colored background layer is uniformly produced opposed to the electroluminescence generated by the EL unit, so that the absorptive member 16 and the counter substrate 11 are not visible from the display side in front of the glass substrate 1.

Alternatively, the absorptive member 16 itself coated by silica gel may be colored to provide the background to the EL unit.

Figure 6:
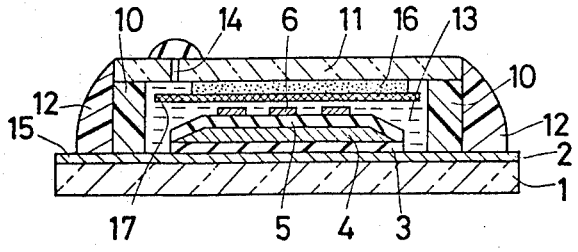

Further, as shown in FIG. 6 wherein like elements corresponding to those of FIG. 1 are indicated by like numerals, there is additionally provided a background plate 17 between the absorptive member 16 and the thin-film EL unit. The background plate 17 is made of synthetic fiber which is colored. It is preferable that the protective liquid 13 impregnates the background plate 17.

Since a cubic expansion coefficient of silicone oil as the protective liquid 13, about $10^{-3}$/°C., is considerably higher than a cubic expansion coefficient of glass used for the glass substrates 1 and/or 11, about $10^{-6}$/°C., the housing of the thin-film EL panel is liable to be damaged by a high temperature, in particular, the adhesion by the adhesives are liable to be easily detached in such a high temperature.

To ensure that the thin-film EL panel can operate in a high temperature, a bubble is introduced into the protective liquid 13 by supplying dried air or dried nitrogen gas ($N_2$). The bubble serves to absorb stress produced inside the housing by the disagreement in cubic expansion coefficients of the materials of the housing and the protective liquid 13.

For an example, a mass of dried air or dried nitrogen gas ($N_2$) to be supplied is about 0.7 to 0.5 cc, depending on the volume of the housing and the kind of adhesive. The thin-film EL panel containing the bubble was resistant to a high temperature up to 75° C. and a high humidity up to 95% while it provided good operations.

Figure 7:
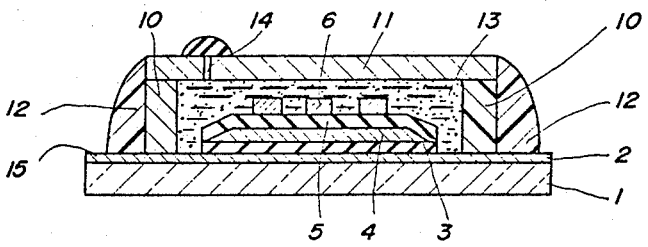

FIG. 7 shows a still further form of thin-film EL display panel according to the present invention. Like elements corresponding to those of FIG. 1 are indicated by like numerals.

In this example, into the protective liquid 13, silica gel particles are dispersed as an absorptive member whose diameter is in the range of about 3 to 75 μm. It is preferable that a ratio of silica gel within silicone oil as the protective liquid 13 be about 0.5 to 5 gram:10 cc.

The EL display panel shown in FIG. 7 is fabricated by the following process. The EL housing, before the injection of the protective liquid 13, and a tank containing the protective liquid 13 inclusive of silica gel particles are both disposed within a vacuum chamber. A pipe for passage of the protective liquid 13 during the injection is connected to the injection hole 14. The tip of the pipe opposite the one connected to the injection hole 14 is first separated from the protective liquid 13.

Under these circumstances, the gas within the vacuum chamber is withdrawn by a vacuum pump. After the chamber is evacuated, the tip of the pipe is placed within the protective liquid 13. Thereafter, the vacuum chamber is returned to atmospheric pressure. The protective liquid 13 contained within the tank can be transferred into the cavity through the pipe. The vacuum chamber can be heated at a temperature of one hundred to two hundred degrees Centigrade for the purpose of enhancing flowing properties of the protective liquid 13.

After the completion of the injection of the protective liquid 13 into the cavity containing the EL unit, the pipe is sealed by a pressing bonding technique. The pipe is then cut at the sealed portion. An epoxy adhesive is coated over the pipe for achieving a complete seal.

As opposed to the example shown in FIG. 1, in this example shown in FIG. 7, the evacuation of gas from the silica gel particles dispersed within the protective liquid 13 can be readily performed together with the evacuation of gas from the protective liquid 13. Moisture contained within the protective liquid 13 which has slow diffusion velocity is rapidly removed.

A precipitate of the silica gel particles after the injection in the housing of the EL panel may occur, thus reducing the visibility of the EL panel. To avoid this disadvantage, a dye material can be dissolved into the protective liquid 13 such that the silica gel particles themselves are colored by the dye material. A color given by the dye material can be used to provide a background to ensure the visibility of the EL panel. Alternatively, after the silica gel particles sufficiently precipitated in the protective liquid 13 before the injection into the housing of the EL device, the silica gel particles being unrequired to be colored, the precipitated silica gel layer is pumped into the housing together with the protective liquid 13, thus becoming approximately full within the housing. In such a case, the white color of the silica gel particles serves as the background of the EL device.

While only certain embodiments of the present invention have been described, it will be apparent to those skilled in the art that various changes and modifications may be made therein without departing from the spirit and scope of the invention as claimed.

What is claimed is:

1. A method for fabricating a thin-film electroluminescent display panel having a thin-film electroluminescent element comprising an electroluminescent layer including an impurity serving as a luminescent center, a pair of dielectric layers formed so as to sandwich said thin-film electroluminescent layer, and electrodes provided on each of said dielectric layers said method comprising:

positioning the thin-film electroluminescent element on a transparent plane substrate;

disposing a counter substrate relative to the transparent plane substrate in such a manner to define a cavity therebetween containing the thin-film electroluminescent element;

introducing a protective liquid containing agents dispersed therein for absorbing moisture into said cavity, the protective liquid being adapted to cover the thin-film electroluminescent element and to penetrate into pin holes present in the dielectric layers; and forming at least one bubble within said protective liquid which bubble functions to compensate for the cubic expansion of said panel due to an increase in temperature.

2. The method according to claim 1 wherein spacer means are provided for determining the position of the transparent plate substrate relative to the counter substrate and further including the step of forming a hole in at least one of said substrates for introducing said protective liquid into the cavity.

3. The method according to claim 2, further including the steps of utilizing an adhesive for combining the transparent plane substrate, the counter substrate, and the spacer means together, introducing the protective liquid onto the cavity through the hole and then sealing the hole.

4. The method according to claim 1, wherein the method further includes heating the protective liquid to a temperature of one hundred to two hundred degrees centigrade.

5. The method according to claim 1, wherein the absorbing member comprises silica gel.

6. The method of claim 1, wherein said bubble is formed by introducing dried air into said cavity containing said protective liquid.

7. The method of claim 1 further including introducing a background means into said cavity for providing a background for the thin-film electroluminescent element.

8. The method of claim 1, wherein said bubble is formed by introducing dried nitrogen gas into said cavity containing said protective liquid.

9. A thin-film electroluminescent display panel comprising:

a pair of non-conductive substrates disposed to define a cavity therebetween;

a composite comprising a thin-film electroluminescent layer sandwiched between a pair of dielectric layers containing pin holes, said composite being disposed within said cavity, at least one of said pair of substrates being transparent to the light emitted by said electroluminescent layer when activated;

a pair of opposing electrodes positioned to define said composite therebetween;

a protective liquid disposed within said cavity defined by said substrates and being in contact with the dielectric layers, such that said protective liquid impregnates said pin holes in said dielectric layers, said protective liquid being inert with respect to the thin-film electroluminescent layer and said dielectric layers, resistant to high voltage, high humidity, high temperature, and having a small vapor pressure and a small coefficient of thermal expansion, said protective liquid further including a bubble formed therein having a volume which functions to compensate for the cubic expansion rate of said protective liquid due to an increase in temperature; and absorbing means within said cavity for absorbing moisture contained within said protective liquid.

10. The display panel according to claim 9, wherein said protective liquid is a silicone oil.

11. The display panel according to claim 9, wherein said protective liquid is a grease.

12. The display panel according to claim 9, wherein the substrates comprise a pair of plane substrates, at least one of which is a transparent glass substrate.

13. The display panel according to claim 12 wherein spacer means are provided between the pair of substrates for determining the position of said substrates relative to each other and at least one hole is formed within one of the substrates for introducing said protective liquid into the cavity.

14. The display panel according to claim 13, wherein an adhesive is further provided for combining the substrates and the means to one another.

15. The display panel according to claim 9, wherein the absorbing means comprises silica gel.

16. The display cell according to claim 9, wherein the absorbing means is a sheet member coated by agents for absorbing moisture.

17. The display panel according to claim 16, wherein said sheet member is disposed on one of the substrates.

18. The display panel according to claim 16, wherein said sheet member is made of aluminum, glass, or plastic.

19. The display panel according to claim 9, wherein the absorbing means comprises absorbent particles dispersed within said protective liquid.

20. The display panel according to claim 19, wherein the particles are confined within a compartment means.

21. The display panel according to claim 20, wherein the compartment is a tube having high moisture transmitting properties.

22. The display panel according to claim 20, wherein said compartment means comprises said spacer means.

23. The element of claim 9, wherein said dielectric layers completely enclose the thin-film electroluminescent layer.

24. The element of claim 9, wherein said electrodes are provided on each of the dielectric layers.

25. The electroluminescent display panel of claim 9 further including a background means for providing a background for said thin-film electroluminescent layer.

26. The display panel according to claim 9, wherein said bubble is formed by dried air.

27. The display panel according to claim 9, wherein said bubble is formed by dried nitrogen gas.

28. A thin-film electroluminescent display panel comprising:

a pair of non-conductive plane substrates, at least one of which is transparent glass substrate disposed to define a cavity therebetween;

a composite comprising a thin-film electroluminescent layer sandwiched between a pair of dielectric layers containing pin holes, said composite being disposed within said cavity, said transparent glass substrate being transparent to light emitted by said electroluminescent layer when activated;

a pair of opposing electrodes positioned to define said composite therebetween;

spacer means provided between said pair of substrate for determining the position of said substrates relative to each other;

a protective liquid disposed within said cavity defined by said substrates and being in contact with said dielectric layers, at least one hole being formed in one of said substrates for introducing said protective liquid into said cavity, said protective liquid impregnating said pin holes in said dielectric layers, said protective liquid being inert with respect to said thin-film electroluminescent layer and said dielectric layers, resistant to high voltage, high humidity, high temperature and having a small vapor pressure and a small coefficient of thermal expansion, said protective liquid further including a bubble formed therein having a volume which functions to compensate for the cubic expansion rate of said protective liquid due to an increase in temperature; and absorbing agents dispersed within said spacer means for absorbing moisture contained within said protective liquid.

* * * * *